US007281634B2

(12) United States Patent
Marchetta et al.

(10) Patent No.: US 7,281,634 B2
(45) Date of Patent: Oct. 16, 2007

(54) SIDE SLIDER FOR STORING OR ORGANIZING OBJECTS

(75) Inventors: Anthony Marchetta, Medina, OH (US); Radu Ghiorghie, Mogadore, OH (US); David M. Stitchick, Wooster, OH (US)

(73) Assignee: Rubbermaid Incorporated, Fairlawn, OH (US)

( * ) Notice: Subject to any disclaimer, the term of this patent is extended or adjusted under 35 U.S.C. 154(b) by 380 days.

(21) Appl. No.: 10/641,258

(22) Filed: Aug. 14, 2003

(65) Prior Publication Data

US 2004/0099625 A1 May 27, 2004

Related U.S. Application Data

(60) Provisional application No. 60/403,414, filed on Aug. 14, 2002.

(51) Int. Cl.
*A47F 5/08* (2006.01)

(52) U.S. Cl. ..... 211/94.01

(58) Field of Classification Search ..... 211/94.01, 211/85.3, 34, 37, 38, 85.31, 81, 96, 110, 162, 211/181.1

See application file for complete search history.

(56) References Cited

U.S. PATENT DOCUMENTS

| | | | | | |
|---|---|---|---|---|---|
| 78,902 | A | * | 6/1868 | Stillman | 211/96 |
| 144,838 | A | * | 11/1873 | DeForest | 211/113 |
| 952,646 | A | * | 3/1910 | Smith | 211/162 |
| 1,689,988 | A | * | 10/1928 | White | 248/27.8 |
| 1,853,061 | A | * | 4/1932 | Judelson | 34/664 |
| 2,098,828 | A | * | 11/1937 | Ludwick | 211/34 |
| 3,913,745 | A | * | 10/1975 | Weiss | 211/34 |
| 4,585,127 | A | * | 4/1986 | Benedict | 211/34 |
| 5,076,442 | A | * | 12/1991 | Hakeem | 211/34 |
| 5,468,063 | A | | 11/1995 | Simonek | 312/334.28 |
| 5,533,534 | A | * | 7/1996 | Cariello et al. | 132/286 |
| 5,779,067 | A | | 7/1998 | Reaney | 211/90.04 |

FOREIGN PATENT DOCUMENTS

| | | |
|---|---|---|
| DE | 202 13 655 U1 | 11/2002 |
| FR | 2 387 620 | 11/1978 |
| FR | 2 797 162 | 2/2001 |
| GB | 2 380 538 A | 4/2003 |

OTHER PUBLICATIONS

International Preliminary Examination Report dated Nov. 23, 2004 for PCT/US03/25296.

* cited by examiner

*Primary Examiner*—Sarah Purol
(74) *Attorney, Agent, or Firm*—Marshall Gerstein & Borun LLP

(57) ABSTRACT

A sliding closet organizer for mounting on an interior vertical surface of a closet wall includes a substantially two-dimensional vertical storage rack and a sliding means adapted for attachment to the interior vertical closet wall surface, wherein the sliding means guides the vertical storage rack into a first stored position and a second deployed position.

21 Claims, 4 Drawing Sheets

SIDE SLIDER FOR STORING OR ORGANIZING OBJECTS

RELATED APPLICATION DATA

This patent claims priority to U.S. provisional application Ser. No. 60/403,414, which was filed on Aug. 14, 2002, the contents of which are expressly incorporated herein by reference.

TECHNICAL FIELD

The present disclosure is generally directed to closet organizers, and more particularly to sliding vertical closet organizers for mounting to an interior wall of a storage area such as a closet.

BACKGROUND

Traditional closet organizers are designed to provide an efficient organizational system intended to maximize the available space within existing closets or other storage areas. To this end, known organizers often employ modular shelves, racks, drawers, and mounting hardware to facilitate design and assembly of units customized to the consumer's needs.

One known organizer includes a main horizontal shelf mounted across the width of the closet at head height (e.g., approximately 5 or 6 feet off the floor). The main shelf is arranged to provide hanging storage of long clothing such as dresses or overcoats and is adapted to serve as a storage shelf. The main shelf is typically mounted using specialized fasteners that include an integral expanding anchor to provide for secured attachment to drywall. Sub-shelves are often mounted below or near the main shelf to equally divide the vertical closet space. In this configuration, shirts and pants or other short clothing items may be hung vertically, relative to each other. Modular shelves, racks, or drawers are further mounted below the main shelf and adjacent to the sub-shelves to provide additional storage for folded items such as bulky clothing, shoes, or other items.

While the known closet organizer described above is designed to maximize the available closet storage space, this organizer neglects (or inefficiently uses) the space on the side walls either behind or to the side of the closet door(s) for the organization or storage of additional items. This inefficient use of space is driven, at least partially, by the fact that the space behind and to the side of the closet door(s) is difficult to access. No known existing solution provides for efficient storage or organization of items in this area.

SUMMARY

A sliding closet organizer for mounting on an interior vertical surface of a closet wall includes a planar vertical storage rack and a sliding means adapted for attachment to the interior vertical closet wall surface, wherein the sliding means guides the vertical storage rack into a first stored position and a second deployed position.

BRIEF DESCRIPTION OF THE DRAWINGS

Objects, features, and advantages of the present device will become apparent upon reading the following description in conjunction with the drawing figures, in which.

DETAILED DESCRIPTION

Although certain features have been described herein in accordance with the teachings of the present disclosure, the scope of coverage of this patent is not limited thereto. On the contrary, this patent covers all embodiments of the teachings of the disclosure that fairly fall within the scope of permissible equivalents.

It would be desirable to design a storage product that slides outward, toward the consumer, from the side space behind the closet door(s) to provide additional storage options. This product could be used to store a variety of items such as shoes, clothes, accessories, craft items, holiday decorations, etc.

Figure 1A:
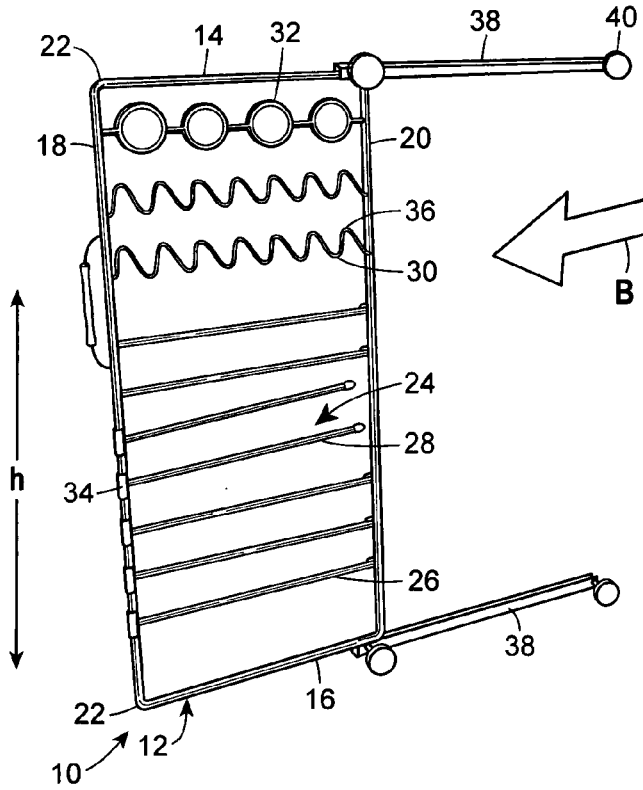
FIG. 1A illustrates a perspective view of an exemplary side slider constructed in accordance with the teachings of the present invention and in an extended or deployed position

FIG. 1A illustrates a side slider assembly, as generally indicated by the numeral 10, in an extended position. The side slider assembly 10 includes a vertical storage rack or frame 12 that has a top bar 14, a bottom bar 16 and a pair of vertical bars 18, 20 all of which lie generally in the same plane. Generally, the vertical storage rack 12 will be manufactured as a roughly rectangular frame structure where the pair of vertical bars 18, 20 are aligned substantially parallel to each other and orthogonal to the top bar 14 and the bottom bar 16. A roughly rectangular vertical storage rack 12 aligned as illustrated in FIG. 1A is advantageous because one form of a typical closet may have a greater height h than a depth d. See FIGS. 1A and 2, respectively.

The vertical storage rack 12 can be manufactured of a single material or several different materials including resins such as, both high and low density polyethylene, polypropylene PET, PVC polycarbonate, etc., wood or particleboard (with or without a laminated surface), wire, steel or metal channel and corrugate. In one example, the vertical storage rack 12 will be constructed from ¼" diameter wire, or similar material, and bent or folded into the above-described rectangular shape. The wire vertical storage rack 12 offers numerous aesthetic advantages such as a smooth, sleek form which my be accentuated by a chrome, matte black or any other desired finish, and a plurality of filleted corners 22 that prevent snags or potentially hazardous points.

It will be understood that the vertical storage rack 12 may alternatively be constructed in a manner analogous to a picture frame, in which each bar or segment is joined at a miter or butt joint. Although this construction may include additional component preparation and manufacturing steps, the reduced packaging, additional material options, and aesthetic considerations may make this construction desirable. The storage rack can also be fabricated as an integral or snap-together plastic structure, if desired.

FIG. 1A further illustrates a plurality of cross bars 24 arranged substantially horizontal, or parallel to the floor when the vertical storage rack 12 is positioned adjacent to the closet wall. The cross bars 24 may be a fixed rail 26, a pivotable rail 28, a shoe rack 30, and a miscellaneous loop or hanger 32. The fixed rail 26 can be permanently attached to the pair of vertical bars 18, 20 via a spot weld, a friction weld or even screws. Alternatively, the cross bars 24, the fixed rail 26, pivotable rail 28 and the shoe racks 30 can be removably attached using a u-shaped clamp (not shown) and a fastener to removably position the rail in a fixed location. These items could also be adjustable snap-in place or drop-in-place modular storage accessories.

Figure 2:
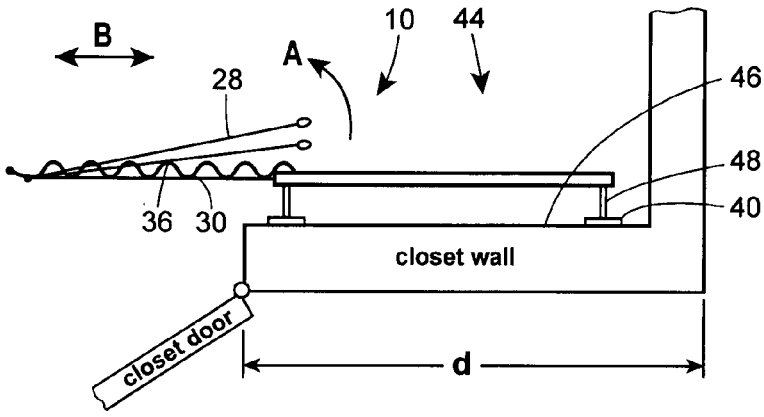
FIG. 2 illustrates a top view of the side slider of FIG. 1B mounted adjacent to a closet wall.

The pivotable rail 28 includes a pivot 34 attached to a vertical bar 18, so that the entire rail pivots away from the opposing vertical bar 20 in an arcing motion A, as illustrated in FIG. 2. In other words, the pivotable rail 28 can be rotated between a first position that is substantially planar to the vertical storage rack 12 and a second position which is defined by any angle (i.e. not planar to the vertical storage rack 12) relative to the interior vertical closet wall surface.

In this way multiple pivotable rails 28, as illustrated in FIGS. 1A and 2, can be used to quickly hang items to be stored such as pants in an overlapping manner.

The shoe rack 30 is intended to address one of the biggest storage needs identified through consumer research. In particular, consumers have indicated that shoe organization is the hardest ongoing organizational problem in closet or home storage space management. The design challenge is to offer an intuitive and easy-to-use storage solution that maximizes the storage space and reduces the appearance of clutter. The wavy or sinusoidal shaped shoe rack 30 offers one potential solution to this storage problem. The sinusoidal-shaped shoe rack 30 includes a plurality of storage peaks 36 sized to fit into and support the toe-portion of a shoe. The miscellaneous hanger 32 can be used to hang belts, scarves, purses, wet or dry towels, robes, or any other bendable or foldable items.

FIG. 1A further illustrates a pair of sliding rails 38 sized to guide and support the vertical storage rack 12. The sliding rails 38 include a plurality of attachment discs 40 each having multiple fastener receiving holes (not shown) through which fasteners may be passed to secure the sliding rails 38 to the closet wall, as shown in FIG. 2. In operation, two of the sliding rails 38 are positioned vertical space from each other and adjacent to the top bar 14 and the bottom bar 16, respectively.

Figure 1B:
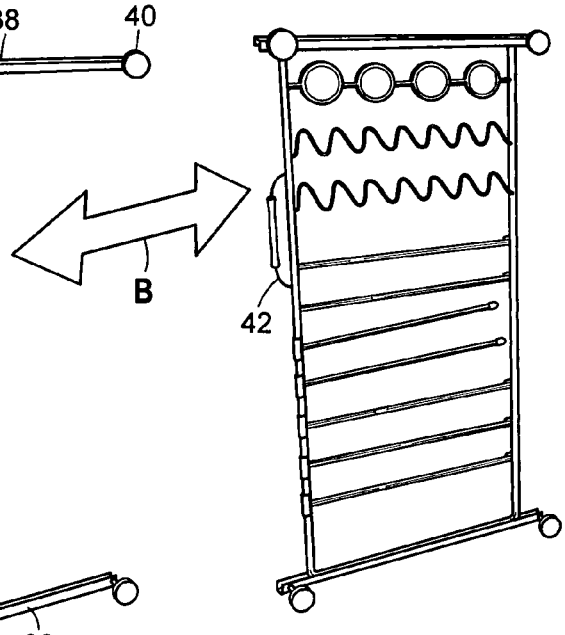
FIG. 1B illustrates a perspective view of the side slider of FIG. 1A in a stored position.

FIG. 1B illustrates the vertical storage rack 12 in a stored position. The vertical storage rack 12 can be linearly translated by the consumer in the directions indicated by the arrow B, by pushing or pulling on the forward facing vertical bar 18. Alternatively, the vertical bar 18 can be constructed with a permanent or removably attached handle 42 to provide a convenient place to grasp and apply a sliding force to linearly translate the vertical storage rack 12.

FIG. 2 illustrates a top view of the side slider assembly 10 affixed to a closet wall within a closet 44. The attachment discs 40 are secured flush to an inner surface 46 of the closet wall. The sliding rails 38 and the attachment discs 40 are separated by a plurality of standoffs 48 to prevent an interference between the closet door (e.g. a bi-fold door) and the vertical storage rack 12 in the extended position. It will be understood that the standoffs 48 can be adjustable in length to allow the sliding rails 38, and thus the entire side slider assembly 10, to be positioned at variable distances, or non-adjustable and designed to provide a fixed desired spacing, relative to the inner surface 46 of the closet wall.

Figure 3:
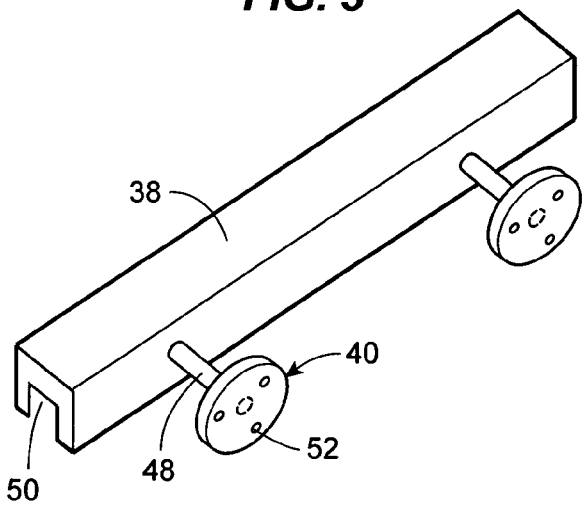
FIG. 3 illustrates a perspective view of one example of a slider rail generally illustrated in FIGS. 1A, 1B and 2.
Figure 4:
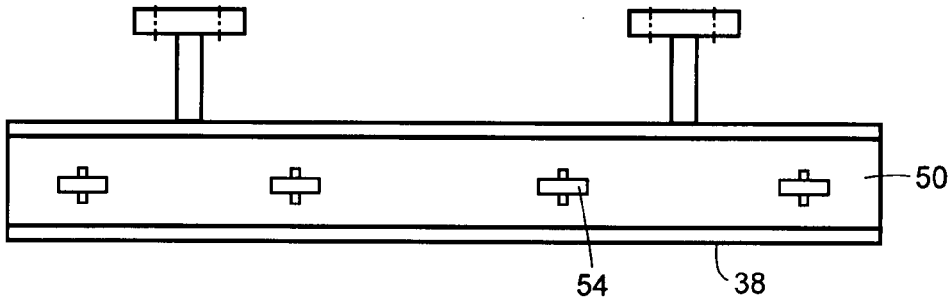
FIG. 4 illustrates a top view of the slider rail of FIG. 3.
Figure 5:
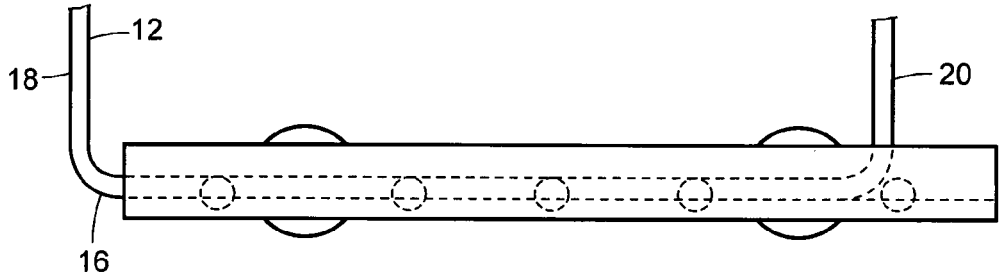
FIG. 5 illustrates a side view of the slider rail of FIG. 3.

FIGS. 3-5 illustrate the sliding rail 38 in various orientations in order to better understand the components and features incorporated therein. In particular, FIG. 3 illustrates a perspective view of the sliding rail 38 positioned in an inverted manner to engage the top bar 14 of the vertical storage rack 12. The inverted sliding rail 38 includes a slider groove 50 sized to accept the top bar 14 and the attachment discs 40 fixedly positioned via the adjustable standoffs 48. It will be understood that a second sliding rail 38 will be positioned in an opposite orientation and spaced beneath the sliding rail 38 depicted in FIG. 3 in order to secure the bottom bar 16 of the vertical storage rack 12 in the complimentary groove 50.

FIG. 4 illustrates a top view of the sliding rail 38, as would be seen by an observer looking down on the sliding rail 38 when it is mounted to the inner surface 46 of the closet wall via the attachment discs 40 and the mounting holes 52 (shown in FIG. 3). The sliding rail 38 can be manufactured with a plurality of rollers 54 sized and spaced to assist the linear translation of the vertical storage rack 12, as indicated by the arrow B in FIGS. 1A and 1B. The rollers 54 may be manufactured as any friction reducing element such as a strip of bearings (linear, ball and/or tapered) or even a plastic or nylon having a low coefficient of friction. Further, the entire sliding rail 38 can be made from a modified U-channel machined or formed to include a slick surface or accept the rollers 54, as shown. In operation, the U-shaped channel of the sliding rail 38 linearly engages the bottom bar 16 of the vertical storage rack 12, as illustrated in the side view of FIG. 5. In another alternative, the sliding rails 38 can each be a pair of telescoping, low-friction tracks without separate bearings.

Figure 6:
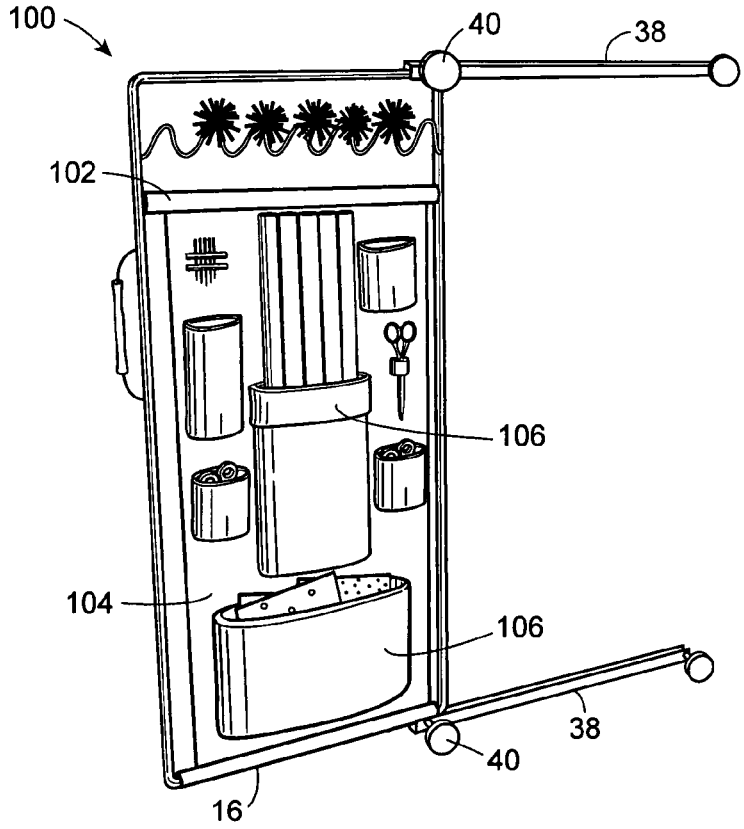
FIG. 6 illustrates a perspective view of another exemplary embodiment of a side slider constructed in accordance with the teachings of the present invention.
Figure 7A:
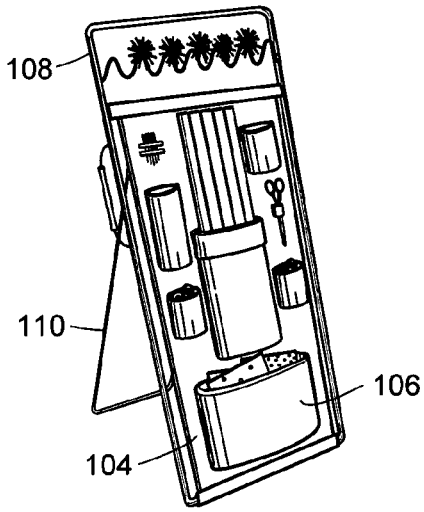
FIG. 7A illustrates a front perspective view of a storage rack, generally shown in FIG. 6, highlighting the removability of the storage rack from the slider rails.
Figure 7B:
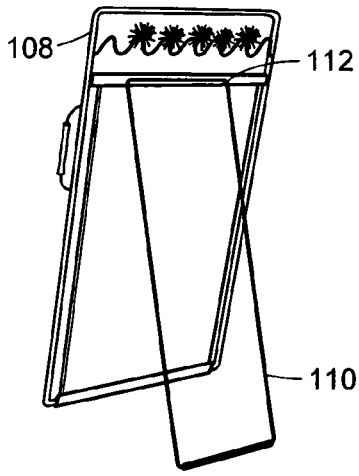
FIG. 7B illustrates a back perspective view of the storage rack generally shown in FIG. 6.

FIGS. 6-7B illustrate an alternate embodiment of the side slider assembly generally indicated by the numeral 100 in FIG. 6. The alternate side slider 100 includes the vertical storage rack 12, a handle 42 and a fixed transverse bar or rail 102. FIG. 6 further illustrates the vertical storage rack 12 adapted to support a canvas or corrugate sheet 104 with pockets 106 of various sizes and shapes. The canvas sheet 104 can be sized to simultaneously engage either the top bar 16 or the fixed rail 102 and either the bottom bar 16 or another fixed rail (not shown in this embodiment. Tension in the canvas sheet 104 may be adjusted by shifting the position of the fixed rail 102, if the rail is positionally adjustable, or by tightening velcro tabs, mounting strings or other any known adjusting or attachment means used to secure the canvas sheet 104 to the rack 12. The pockets 106 can be designed to hold any type of item, including craft items such as pencils, scissors, paper rolls or other loose items. Additional cross bars 24 of the type described above in connection with FIG. 1A may be used as desired and/or required by the consumer.

FIGS. 7A and 7B illustrate an alternate embodiment of the vertical storage rack 108 that can be removed from the sliding rail 38 and supported via an easel arm 110. The easel arm 110 can be attached to the vertical storage rack 108 at pivots points 112 along the fixed rail 102 or along the vertical bars 18, 20. It may be desirable to package a positionable fixed rail 102 with a pivotable easel arm 110 and the canvas sheet 104 to facilitate removal and use of the vertical storage rack 108 as a separate structure. The sliding rails 38 and/or the bars 14, 16 can be configured to permit easy release of the storage rack 12 from the groove 50 when pulled by the end-user.

Figure 8:
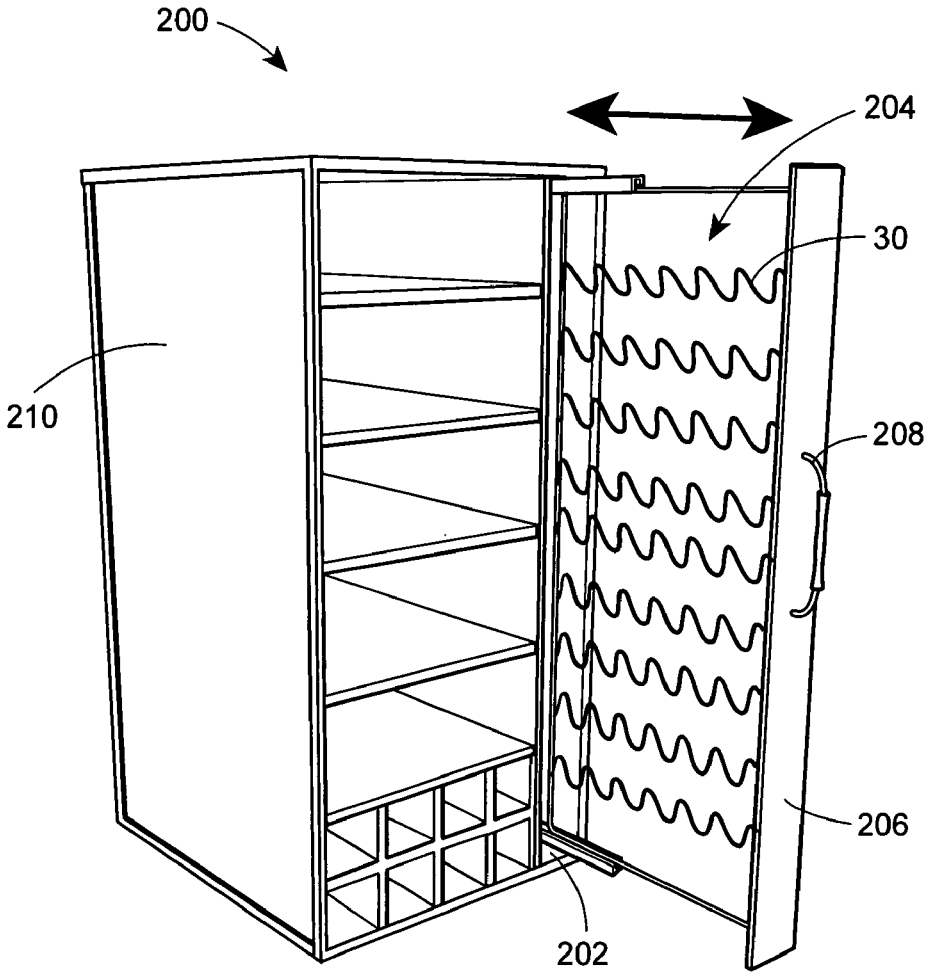
FIG. 8 illustrates a perspective view of an alternate embodiment of an exemplary side slider.

FIG. 8 illustrates another embodiment of the side slider configured as a stand-alone organizer 200 that provides a unique storage solution using a sliding mechanism to access a dedicated shoe storage area 202. The stand-alone organizer 200 is intended to hide or conceal the visual clutter that accompanies piles or stacks of shoes stacked on the floor of the closet. The design saves and/or maximizes closet floor space and storage space by using a vertical shoe storage rack 204 arranged with a plurality of sinusoidal-shaped shoe racks 30 to hang and store shoes vertically. The vertical shoe storage rack 204 can be concealed within the dedicated shoe storage area 202 by a decorative panel 206 which, in turn, may include a handle 208 or integral grip or handhold. The decorative panel 208 may be a wood panel, a laminate panel manufacture to include simulated wood grain, a plastic panel, or the like. It will be understood that although the stand-alone organizer 200 is shown as a separate, free standing unit that may be manufactured from modular laminate pressboard pieces to facilitate setup and minimize the packaging requirements, the organizer hardware, including the vertical shoe storage rack 204 and the sliding means described in FIGS. 3-5 may be sold as individual or packaged components to install in an existing closet organization system.

The stand-alone organizer 200 and the vertical shoe storage rack 204 can be manufactured from a wire material and include plastic or metal hooks to facilitate hanging of shoes. In operation, the wire vertical shoe storage rack 204 linearly translates, as indicated by the arrow C, along a track or rail similar to the one described in conjunction with FIGS. 3-5, and offers access to the shoes storage area 202. When not in use, or in the extended position, the shoe storage area 202 is concealed inside a cabinet 210 which may be made of any suitable material such as melamine. The shoe storage area 202 is accessed by linearly translating or sliding the wire vertical shoe storage rack 204 using the handle 208 on the side of the decorative panel 206 or other slider facing.

Further, the stand-alone organizer 200 may also come as a separate unit or can be pre-attached to an existing shelving unit. In the separate unit option, the vertical shoe storage rack 204 can extend along the entire height h, see FIG. 1A, of the closet and have a storage capacity of about 30-40 pairs of shoes. The vertical shoe storage rack 204 may also come in smaller units with a storage capacity of 10-15 pairs of shoes. Either the capacity or the size of the vertical shoe storage rack 204 may be designed to slide entirely inside the complimentary cabinet 210. There are multiple materials options for the main cabinet. The units could be made out of wood, melamine, plastic, wire, or a combination of these materials. There are also freestanding units options to the design. The freestanding units are modular and offer a large variety of assembly options and storage capacity.

Although certain side sliders have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A sliding closet organizer for mounting on a vertical surface comprising:

a vertical storage frame comprising:

a top perimeter bar, a bottom perimeter bar and a pair of vertical bars; and top and bottom sliding rails attached to the vertical surface, wherein the top and bottom sliding rails guide and support the vertical storage frame during a linear translation substantially parallel to the vertical surface between a first stored position and a second deployed position, wherein the linear translation is substantially perpendicular to an opening of a storage space, wherein the top sliding rail receives a portion of the top perimeter bar within a groove formed in the first sliding rail, and wherein the bottom sliding rail receives a portion of the bottom perimeter bar within a groove formed in the second sliding rail.

2. The sliding closet organizer of claim 1, wherein the vertical storage frame is a substantially rectangular structure.

3. The sliding closet organizer of claim 2, wherein the substantially rectangular structure is held vertically within the grooves formed in the top and bottom sliding rails.

4. The sliding closet organizer of claim 2, wherein the vertical storage frame includes a pivotable transverse bar adapted to hang pants.

5. The sliding closet organizer of claim 4, wherein the pivotable bar is attached to one of the vertical pair of perimeter bars, and rotatable between a first position substantially planar to the substantially rectangular structure and a second position defining an angle relative to the vertical wall surface.

6. The sliding closet organizer of claim 1, wherein the vertical storage frame is a formed wire rack.

7. The sliding closet organizer of claim 1, wherein the vertical storage frame includes a sinusoidal wire shoe rack adapted to store shoes.

8. The sliding closet organizer of claim 1, wherein the vertical storage frame includes a handle.

9. The sliding closet organizer of claim 1, wherein the top and bottom sliding rails include mounting brackets for attachment to the vertical surface.

10. The sliding closet organizer of claim 1, wherein the vertical storage rack supports a flexible storage surfaced having a plurality of pockets.

11. The sliding closet organizer of claim 1, wherein the vertical storage rack includes a pivotable stand, the pivotable stand deployable for use when the storage frame is removed from the sliding means.

12. A storage unit comprising:

first and second vertical walls and top and bottom walls cooperating to form at least one storage space;

a first slide rail affixed to the first vertical wall and adjacent to the top wall;

a second slide rail affixed to the first vertical wall opposite the first slide rail and adjacent to the bottom wall;

a storage rack adapted to be slidably mounted between the first and second slide rails, wherein the storage rack is slidable substantially parallel to the first vertical wall and substantially perpendicular to an opening in the at least one storage space between a first position adjacent to a back wall and a second position distal to the back wall.

13. The storage unit of claim 12, wherein the storage rack includes a plurality of storage bars.

14. The storage unit of claim 13, wherein at least one of the plurality of storage bars is a sinusoidal storage bar adapted to store shoes.

15. The storage unit of claim 12, wherein at least one of the plurality of storage bars supports a flexible storage surface having a plurality of pockets.

16. The storage unit of claim 12, wherein at least one of the plurality of storage bars is a pivotable pants rack.

17. The storage unit of claim 12, wherein the storage unit further includes a rectangular decorative panel adapted to close the at least one storage space.

18. An organizer comprising:

a vertically oriented rectangular wire frame having a top bar and a bottom bar and at least one substantially horizontal storage bar, wherein the storage bar is selected from the group consisting of a sinusoidal shoe rack, a pivotable pants rack, a fixed position storage bar, or an adjustable storage bar;

a bottom sliding rail affixed to a vertical wall of a storage space and slidably supporting the bottom bar ; and a top sliding rail positioned to slidably support the top bar of the rectangular wire frame, wherein the top sliding rail is affixed to the vertical wall and cooperates with the bottom sliding rail to guide the linear translation of rectangular wire frame substantially parallel to the vertical wall between a first stored position and a second deployed position.

19. A sliding closet organizer comprising:

a top slide rail and a bottom slide rail, the top and bottom slide rails mounted to a vertical closet sidewall and disposed perpendicular to a closet back wall, the top and bottom slide rails each forming a slide track; and a storage rack assembly engaging the top and bottom slide rails, the storage rack assembly shiftable along the slide track between a stowed position in which a rear end of the storage rack assembly is disposed adjacent a rear portion of the slide track and a deployed position in which the rear end of the storage rack assembly is spaced away from the rear portion of the slide track, wherein the top and bottom slide rails each include a plurality of laterally extending adjustable mounting standoffs, the top slide rail including a downwardly oriented groove and the bottom slide rail including an upwardly oriented groove.

20. The closet organizer of claim 19 wherein the slide tracks are defined at least in part by U-shaped channels.

21. A sliding organizer for use with a closet having a vertical sidewall, the organizer comprising:

a storage rack comprising a wire frame having a top wire, a bottom wire, and a pair of side wires, the wire frame defining a plane;

a top slide rail having a downwardly facing groove engaging the top wire;

a bottom slide rail having an upwardly facing groove engaging the bottom wire;

each of the top and bottom slide rails having a pair of horizontally extending standoffs sized for mounting to the vertical sidewall of the closet such that the storage rack may be secured between the top and bottom slide rails with the plane of the wire frame parallel to the vertical sidewall;

the top and bottom slide rails cooperating with the wire frame to permit the wire frame to shift between a stowed position in which the top and bottom wires are disposed adjacent the top and bottom slide rails and a deployed position in which at least a portion of the top and bottom wires are pulled out of engagement with the top and bottom slide rails.

* * * * *

UNITED STATES PATENT AND TRADEMARK OFFICE

CERTIFICATE OF CORRECTION

PATENT NO. : 7,281,634 B2
APPLICATION NO. : 10/641258
DATED : October 16, 2007
INVENTOR(S) : Anthony Marchetta et al.

It is certified that error appears in the above-identified patent and that said Letters Patent is hereby corrected as shown below:

In the Claims:

At Column 6, Claim 12 line 51, "opposite" should be -- opposing--.

Signed and Sealed this

Thirteenth Day of January, 2009

JON W. DUDAS
*Director of the United States Patent and Trademark Office*